US009913545B2

(12) United States Patent
Loewen

(10) Patent No.: US 9,913,545 B2
(45) Date of Patent: Mar. 13, 2018

(54) SLATTED BED BASE

(71) Applicant: Sino Europe GmbH & Co. KG, Gummersbach (DE)

(72) Inventor: Jakob Loewen, Gummersbach (DE)

(73) Assignee: Sino Europe GmbH & Co. KG, Gummersbach (DE)

( * ) Notice: Subject to any disclaimer, the term of this patent is extended or adjusted under 35 U.S.C. 154(b) by 177 days.

(21) Appl. No.: 14/874,495

(22) Filed: Oct. 5, 2015

(65) Prior Publication Data

US 2016/0206487 A1 Jul. 21, 2016

(30) Foreign Application Priority Data

Jan. 19, 2015 (DE) ..... 10 2015 100 703

(51) Int. Cl.
*A47C 20/04* (2006.01)
*A47C 20/08* (2006.01)

(52) U.S. Cl.
CPC ..... *A47C 20/04* (2013.01); *A47C 20/041* (2013.01); *A47C 20/08* (2013.01)

(58) Field of Classification Search
CPC ..... A47C 20/04
USPC ..... 5/613–618
See application file for complete search history.

(56) References Cited

U.S. PATENT DOCUMENTS

2002/0162170 A1* 11/2002 Dewert ..... A47C 20/041 5/617
2016/0015583 A1* 1/2016 Dewert ..... A47C 19/12 5/616

FOREIGN PATENT DOCUMENTS

DE 19522492 A1 1/1997
DE 29915478 U1 11/1999
DE 202012011747 U1 1/2013

OTHER PUBLICATIONS

German Office Action dated Dec. 6, 2016 for the German Application DE 102015100703.7.

* cited by examiner

*Primary Examiner* — Fredrick C Conley
(74) *Attorney, Agent, or Firm* — Bachman & LaPointe, PC

(57) ABSTRACT

A slatted bed base having an outer frame as well as a reclining surface which surface comprises at least two parts and is arranged at the outer frame, wherein at least one part is configured as a pivotable part, which is pivotable around a pivot axis relative to the outer frame by an adjustment unit from a flat position into at least one adjusted position, wherein the adjustment unit is pivotable relative to the outer frame about a first pivot point and relative to the pivotable part about a second pivot point. In order to provide a slatted bed base that can be produced in a particularly cost-efficient manner and at the same time has a compact construction mode as well as a low construction height, the first pivot point for arranging the adjustment unit relative to the outer frame is arranged between the pivot axis of the pivotable part and the second pivot point of the adjustment unit.

21 Claims, 6 Drawing Sheets

SLATTED BED BASE

BACKGROUND OF THE INVENTION

The invention relates to a slatted bed base having
an outer frame as well as
a reclining surface which comprises at least two parts and which is arranged on the outer frame, wherein
at least one part is configured as a pivotable part that can be pivoted around a pivot axis relative to the outer frame from a flat position into at least one adjusted position by means of an adjustment unit, wherein
the adjustment unit can be pivoted relative to the outer frame about a first pivot point and relative to the pivotable about a second pivot point.

Slatted bed bases of the above type are known in various configurations from the prior art. Slatted bed bases of such type are used in the private sector, particularly in combination with a bed stead as well as a mattress, but also in the medical sector as well as in the nursing care sector for hospital beds, care beds and senior care beds.

The pivotable arrangement of at least one part of the reclining surface allows adjusting the shape of the bed to the needs of the user. This finds application when adjusting into a desired sleeping position, e.g. by elevating a leg section, as well as when changing from the sleeping position into a sitting position of the user, for example.

In particular, it is known from the prior art to use an adjustment unit for pivoting at least part of the reclining surface, wherein one end of the adjustment unit is arranged opposite the outer frame of the slatted bed base and the other end is arranged at the pivotable part.

However, the slatted bed bases known from the prior art have the disadvantage that on the one hand a powerful and thus expensive adjustment unit is needed due to unfavorable geometric conditions and on the other hand, the slatted bed base has a great construction height particularly because of the adjustment unit. Furthermore, it is not possible to operate the slatted bed bases known from the prior art on an even base, respectively lying on the floor, since the adjustment units installed therein at the side of the outer frame opposite the reclining surface, which side is usually facing the floor, are arranged thereon in a protruding manner.

SUMMARY OF THE INVENTION

It is therefore the object of the invention to provide a slatted bed base that can be produced in a particularly cost-efficient manner, comprising a compact construction mode and a low construction height.

According to the invention, said object is achieved by a device as disclosed herein. Advantageous further developments of the invention are also indicated.

The slatted bed base according to the invention comprises an outer frame as well as a reclining surface which comprises at least 2 parts and which is arranged on the outer frame. At least one part of the reclining surface is configured as a pivotable part, which can be pivoted around a pivot axis relative to the outer frame by means of an adjustment unit from a flat position into at least one adjusted position, wherein the adjustment unit is pivotable relative to the outer frame about a first pivot point and relative to the pivotable part about a second pivot point. The slatted bed base is characterized in that the first pivot point for arranging the adjustment unit relative to the outer frame is arranged between the pivot axis of the pivotable part and the second pivot point of the adjustment unit.

When compared to the slatted bed bases known from the prior art, the slatted bed base according to the invention results in the advantages that due to the advantageous geometry resulting from the configuration of the invention a particularly cost-efficient adjustment unit can be used without decreasing the stability thereof or reducing the maximum available power effective between the outer frame and the pivotable part. Furthermore, the configuration according to the invention allows constructing a slatted bed base with a low construction height, which can be operated on an even base, especially lying on the floor.

First, a slatted bed base can be any device that is suitable as a base for at least one upholstered element, in particular a mattress, of a bed or of another resting or sleeping furniture. In particular, the slatted bed base is a component or construction unit, which can be arranged on a bed stead for receiving an upholstered element of this type. Furthermore, the slatted bed base may comprise other desired features.

Basically, the slatted bed base comprises an outer frame which can be formed in one piece or in multiple pieces from an arbitrary material. The outer frame preferably consists essentially of metal, synthetic material, wood, a composite material or a combination of several of the aforementioned materials. Here, the outer frame can be formed as to limit the slatted bed base on all four sides or to consist only of two lateral components connected to one another by means of connecting elements. Basically, it is understood for the outer frame to be the component that provides the slatted bed base with the required dimensional stability.

The reclining surface is basically understood to be the component, respectively the construction unit, which is located at the side of the slatted bed base that the upholstered element is to be arranged on or that faces a user. Here, the reclining surface can be formed by a plurality of different components, wherein said components preferably comprise elastic elements made of wood, synthetic material or metal.

The slatted bed base according to the invention comprises a reclining surface comprising at least two parts, wherein these parts are separate, but structurally connected portions of the reclining surface, which are adjustable relative to one another, preferably by means of pivoting or tilting.

The pivot axis is basically understood to be the geometrical axis that the pivotable part of the reclining surface can be pivoted around relative to the rest of the reclining surface, respectively the outer frame of the slatted bed base. Here, the pivot axis is particularly formed by fitting axes arranged on both sides of the outer frame, by bolts or by other types of fixing elements.

An adjustment unit is basically understood to be a construction element or a construction group suitable for adjusting at least a part of the reclining surface relative to the outer frame, respectively relative to the other part of the reclining surface, in particular for changing the angle between two parts of the reclining surface. Here, it may be a strictly mechanical device or an electrically-adjustable device. The adjustment unit can be arranged directly at the outer frame or the inner frame, or it may interact with one of the frames by means of an arbitrary construction element, e.g. a cross-support. Preferably, the adjustment unit is arranged on a cross-support running inside the outer frame, respectively the inner frame, which is why a particularly compact and stable construction mode is achieved.

The first and second pivot points are basically the positions of the slatted bed base which the adjustment unit is arranged on in an articulate manner relative to the outer frame, respectively the pivotable part. Here, this is preferably a swivel joint arrangement, wherein particularly preferred the arrangement is effected in each case along a rotational axis, running in parallel to the pivot axis of the pivotable part, opposite the outer frame. Particularly preferred, the rotational axes through each of the two pivot points as well as the pivot axis are running parallel to one other.

A flat position of the pivotable part of the reclining surface is the position in which said part of the reclining surface is arranged parallel to the outer frame and/or in a plane with the remaining part of the reclining surface. Here, said flat position is the position in which a pivotable part of the reclining surface has the smallest possible adjustment angle relative to the outer frame, respectively the remaining reclining surface, usually of approximately 0°.

In contrast, the adjusted position is basically a position of the pivotable part of the reclining surface, characterized by an angle that differs from the adjustment angle of the flat position, wherein the adjusted position it is particularly understood to be the position of the maximum possible adjustment of the pivotable part of the reclining surface relative to the outer frame by means of the adjustment unit. Basically, angles of the pivotable part of the reclining surface relative to the outer frame of up to 90° are conceivable, in the case of special applications even more.

The arrangement according to the invention of the first pivot point between the pivot axis and the second pivot point is an arrangement in which the first pivot point is arranged in a region between the pivot axis and the second pivot point when viewed in longitudinal direction of the outer frame, respectively the longitudinal axis of the reclining surface.

According to an advantageous further development of the invention, the first pivot point relative to the reclining surface or viewed in vertical direction to the reclining surface is arranged below the pivot axis and/or below the second pivot point, wherein preferably the pivot axis and the second pivot point essentially have the same distance to the reclining surface, ensuring a sufficient power transmission of the adjustment unit to the pivotable part in a particularly simple manner, even in the flat position.

According to another advantageous further development of the invention, the pivot axis and the two pivot points are arranged such that they form a power triangle in direction of the reclining surface.

Here, the first pivot point is preferably arranged in vertical direction to the reclining surface below a straight that connects the pivot axis and the second pivot point. Also preferred, the distance between the pivot axis and the first pivot point is in a range between 100% and 10% of the distance between the first and the second pivot point, in particular in the flat position, particularly preferred between 80% and 20% and very particularly preferred between 75% and 30%. Further preferred, the distance between the first and the second pivot point and thus the length of the adjustment unit in the completely retracted state/in the flat position is between 60 cm and 10 cm, particularly preferred between 50 cm and 20 cm and very particularly preferred between 45 cm and 25 cm.

According to an advantageous embodiment of the invention, the reclining surface, particularly the pivotable part of the reclining surface, comprises an inner frame arranged at the outer frame. Here, the inner frame can basically be formed in one piece but as well be formed in several pieces of an arbitrary material. Preferably, the inner frame is made of metal, synthetic material, wood, a composite material or a combination of multiple of the aforementioned materials and particularly preferred of the same material as the outer frame. Here, the inner frame can surround the reclining surface, respectively the pivotable part of the reclining surface, on all four sides, or merely consist of two lateral components connected to one another by means of connecting elements. According to a particularly advantageous embodiment of the invention, the inner frame is pivotably arranged directly at the outer frame, which is why the pivotability of one part of the reclining surface can be realized in a particularly simple manner.

According to a preferred embodiment of the invention, the reclining surface, in particular the pivotable part of the reclining surface, comprises several elastic support elements arranged in parallel to one another. In particular, the reclining surface may comprise a plurality of slats made of wood or synthetic material arranged parallel to each other, respectively metal or wire elements arranged in parallel or in grid-type manner. Here, the elastic elements can directly be connected to the outer frame or the inner frame or be a part of a construction group arranged at the outer frame.

According to another preferred embodiment of the invention, the pivot axis of the moveable part is arranged in the area of the reclining surface, preferably between the elastic support elements and/or above the outer frame, which is why the geometric conditions between the pivot axis and the two pivot points are particularly favorable for a maximum power transmission of the adjustment unit, in particular since a force triangle with a sufficient height is generated by the two pivot points and the pivot axis in flat position of the pivotable part as well.

In an advantageous further embodiment of the invention, the adjustment unit is arranged inside the slatted bed base, in particular inside the outer frame so that said unit does at least not protrude from the slatted bed base, respectively the outer frame, on the side of the slatted bed base opposite the reclining surface, which is why the slatted bed base has a particularly low construction height and further can be operated in an advantageous manner when lying on an even base.

According to a preferred further embodiment of the invention, the adjustment unit comprises a linear adjuster, which preferably comprises a spindle drive allowing a particularly low-noise adjustment and the self-locking effect of the spindle drive preventing an undesired adjustment, e.g. caused by the weight force of users, at the same time in a simple manner.

According to an advantageous embodiment of the invention, the adjustment unit comprises an electric motor, releasable and by means of which the pivotable part of the reclining surface can thus be continously pivoted preferably from the flat position into a maximum adjusted position, which is why the slatted bed base can be adjusted by a user in a particularly simple manner.

According to an advantageous further embodiment of the invention, the adjustment unit, in particular the electric drive, is arranged on the slatted bed base, in particular on the outer frame and/or the pivotable part in an easily replaceable manner, wherein the electric drive is preferably arranged on a motor mount fixed in position relative to the outer frame or the pivotable part. Such a configuration of the slatted bed base allows repairing the slatted bed base in a particularly simple manner in the case of a defect and thus improves the life cycle as well as the quality of the slatted bed base.

According to a preferred embodiment of the invention, the reclining surface comprises as a pivotable part a leg section and/or an upper body section pivotable relative to the outer frame. It is also preferred that the pivotable leg section is formed by an upper leg section and a lower leg section interconnected in an articulate manner. It is further preferred that the pivotable upper body section comprises a back section and a head section which are connected to one another in an articulate manner. Such configurations allow a versatile adjustability and individualization of the adjustable slatted bed base in a particularly simple manner.

According to another preferred embodiment of the invention, the distance between the outer frame and at least a part of the reclining surface, preferably at least a pivotable part of the reclining surface and particularly preferred all pivotable parts of the reclining surface and very particularly preferred the inner frame, is at least 25 mm, preferably at least 28 mm, which is why a trapping of the user, in particular of his fingers, between parts of the reclining surface, in particular the inner frame and the outer frame, is prevented in a particularly simple way when adjusting the slatted bed base.

According to an advantageous further embodiment of the invention, the adjustment unit is arranged on the pivotable upper body section such that when pivoting out of the flat position, first the head section is pivoted and afterwards, upon further actuation of the adjustment unit, the back section is pivoted as well, which is why by means of one single adjustment unit the upper body section can be brought into a reading position with only the head section elevated, as well as into a sitting position with the back section being angled off as well.

BRIEF DESCRIPTION OF THE DRAWINGS

An exemplary embodiment of the slatted bed base according to the invention is explained more detailed hereinafter with reference to the drawings. The figures show in.

DETAILED DESCRIPTION

Figure 1:
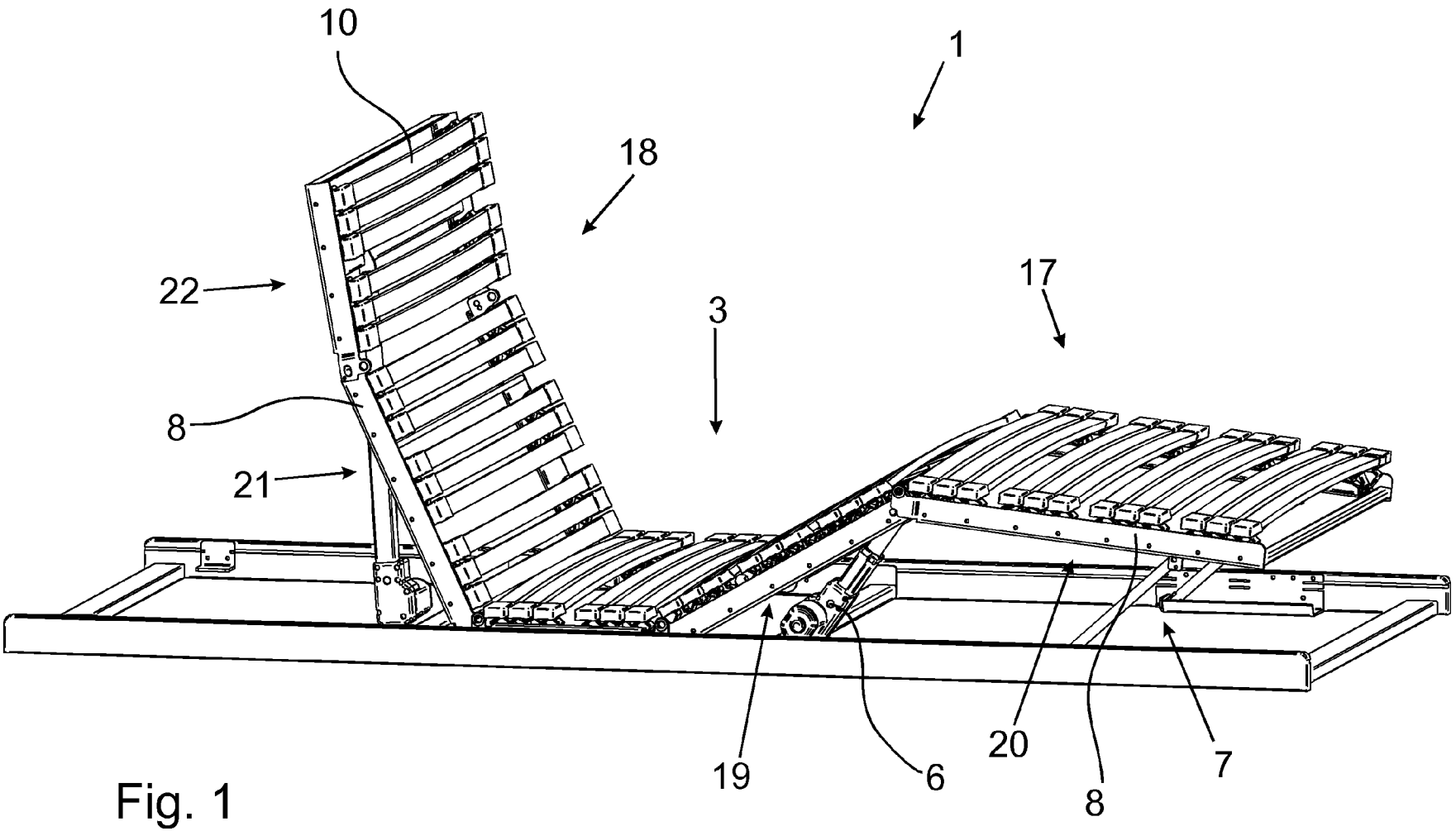
FIG. 1 a perspective view of the slatted bed base with a leg section as well as an upper body section in an angled position, FIG. 2*a* a side view of the slatted bed base with illustrated force triangles of the adjustment units arranged on the slatted bed base, FIG. 2*b* a top view of the slatted bed base with adjustment units arranged on the slatted bed base, FIG. 2*c* a top view of a frame construction of the slatted bed base, FIG. 3 a perspective view of a slatted bed base with a head section in an angled position, FIG. 4 a perspective view of the slatted bed base with the upper body section in the angled position, and FIG. 5 a perspective view of the slatted bed base with the upper body section as well as the leg section in a flat position.

A slatted bed base 1 shown in FIG. 1 comprises an outer frame 2 surrounding the slatted bed base 1. On the outer frame 2 a reclining surface 3 is arranged, which is formed by multiple parts 4, 5 pivotable relative to one another. Each of the parts 4, 5 of the reclining surface 3 is formed by an inner frame 8 surrounding the parts 4, 5 as well as by elastic wooden slats 10 arranged thereon. Here, the inner frames 8 are each arranged inside the outer frame 2.

The adjustable slatted bed base 1 particularly comprises a leg section 17 moveable relative to the outer frame 2, which is formed by an upper leg section 19 arranged on the outer frame 2 as well as by a lower leg section 20 which is articulately arranged on the upper leg section 19. The slatted bed base 1 further comprises an upper body section 18 which is formed by a back section 21 pivotably arranged at the outer frame 2 as well as by a head section 22 arranged in an articulate manner on the back section 21.

In order to be able to pivot the pivotable parts 4, 5 of the reclining surface 3 relative to the rest of the reclining surface 3, respectively the outer frame 2, the inner frame 8 of the pivotable parts 4, 5 is disposed at the outer frame 2 articulately relative to a pivot axis S. Further, an adjustment unit 6 is arranged between the outer frame 2 and at least one of the moveable parts 4, 5 of the reclining surface 3.

Figure 2A:
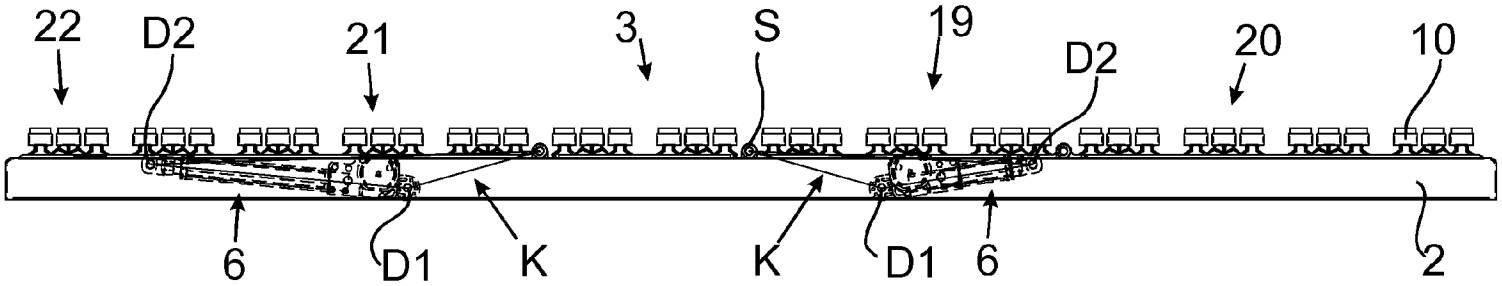
Figure 2B:
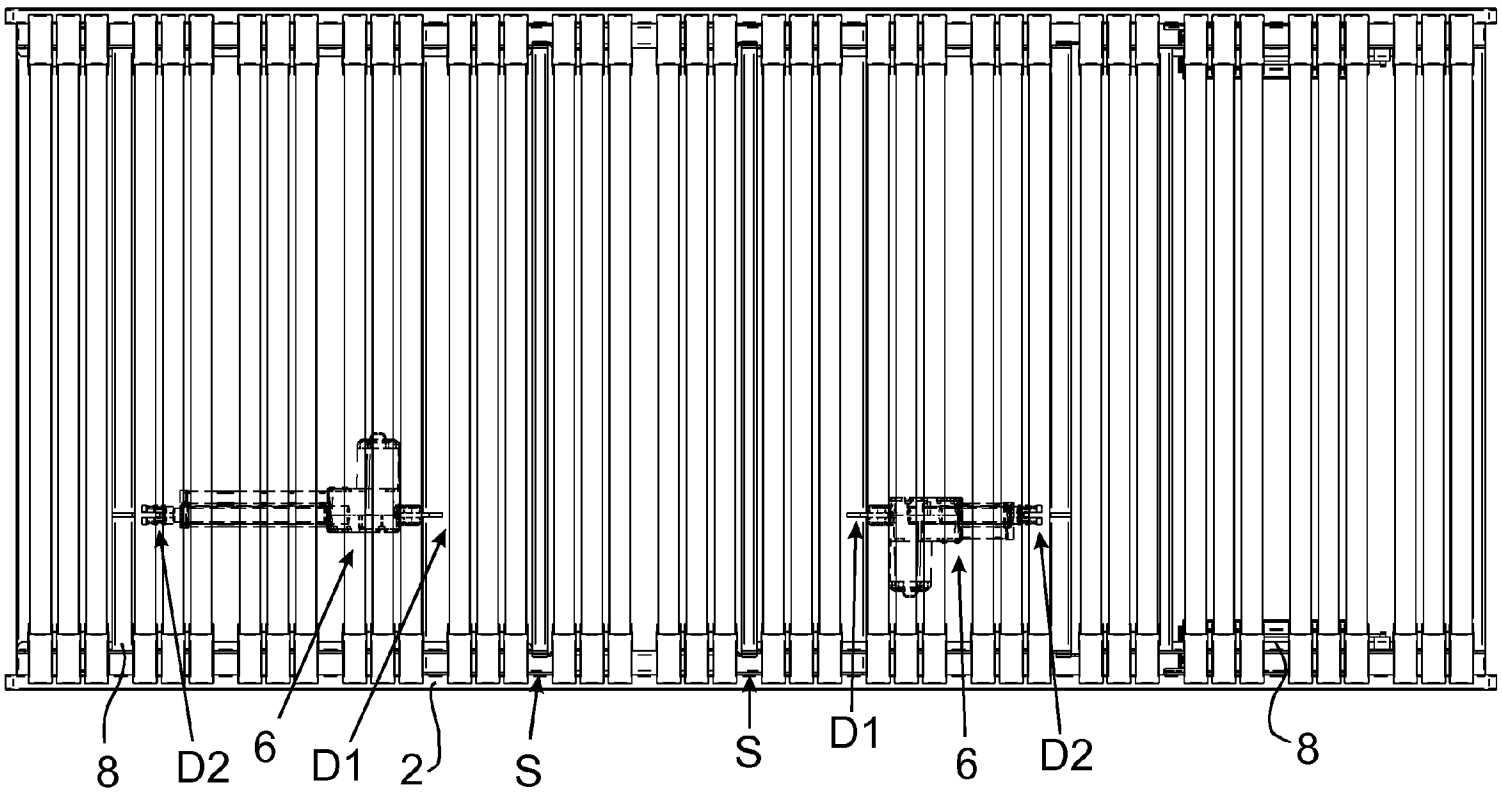
Figure 2C:
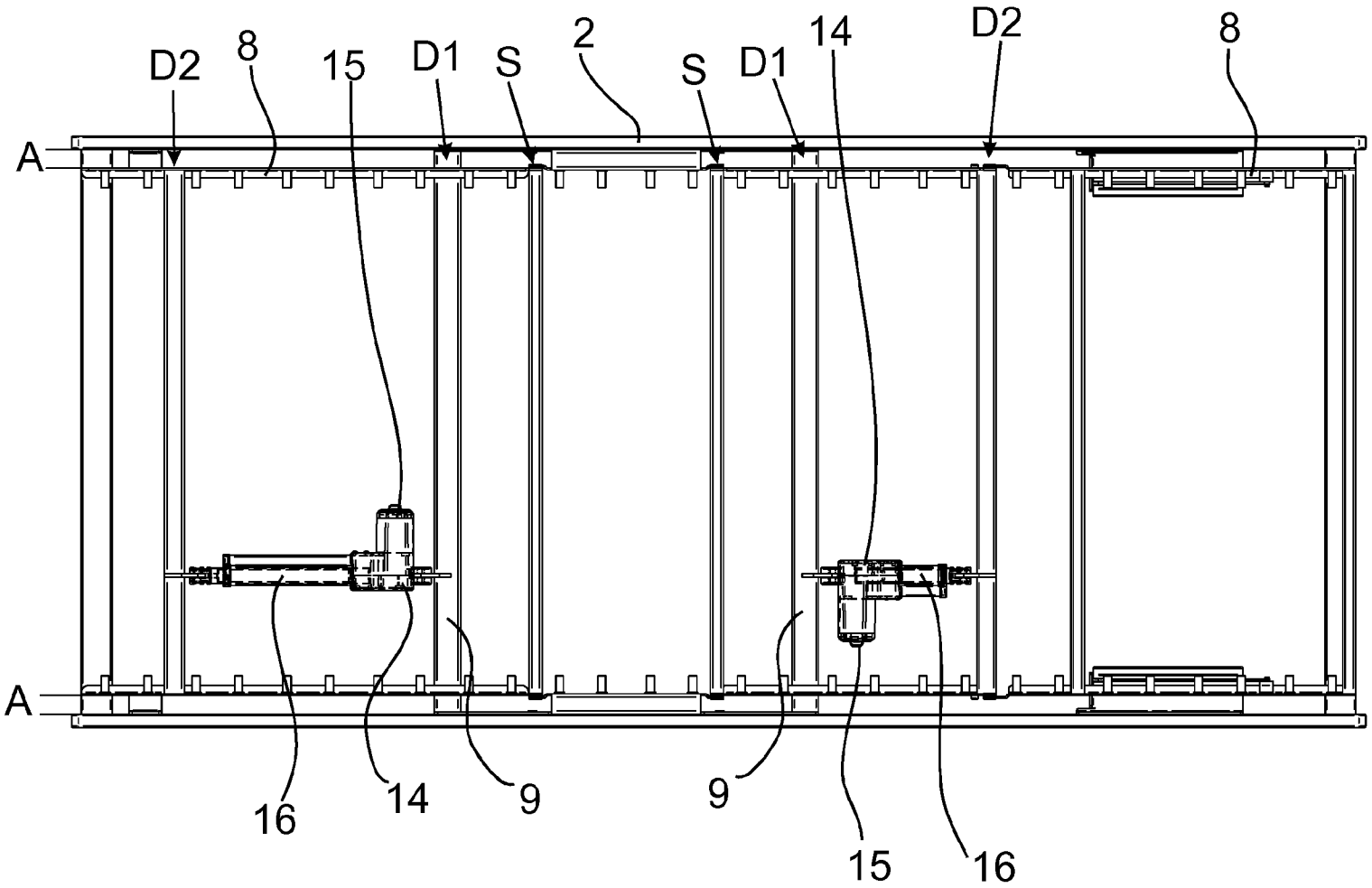

Here, one end of the adjustment unit 6—as shown in FIGS. 2*a* to 2*c*—is arranged at a first pivot point D1 on the outer frame 2 in an articulate manner and the other end at a second pivot point D2 on the pivotable part 4 in an articulate manner. Here, the two pivot points D1, D2 as well as the pivot axis S of the inner frame 8 are arranged such that said parts—even in the flat position—form a force triangle K, wherein the pivot axis S is arranged in the area of the reclining surface 3 between two elastic wooden slats 10, and the second pivot point D2 is also arranged in the area of the reclining surface 3, respectively the upper edge of the outer frame 2, facing the reclining surface 3, with the first pivot point D1 of the adjustment unit 6 being located at a side of the outer frame 2, opposite the reclining surface 3 (see particularly FIG. 2*a*).

The adjustment unit 6 is formed by an electric drive 15, which by means of a motor mount 14 is arranged at the outer frame 2, respectively on a cross support 9 arranged thereon, as well as by a spindle drive 16 fixed relative to the leg section 17, here particularly the upper leg section 19, respectively the upper body section 18, here particularly the head section 22 (see FIG. 2*c*).

Figure 3:
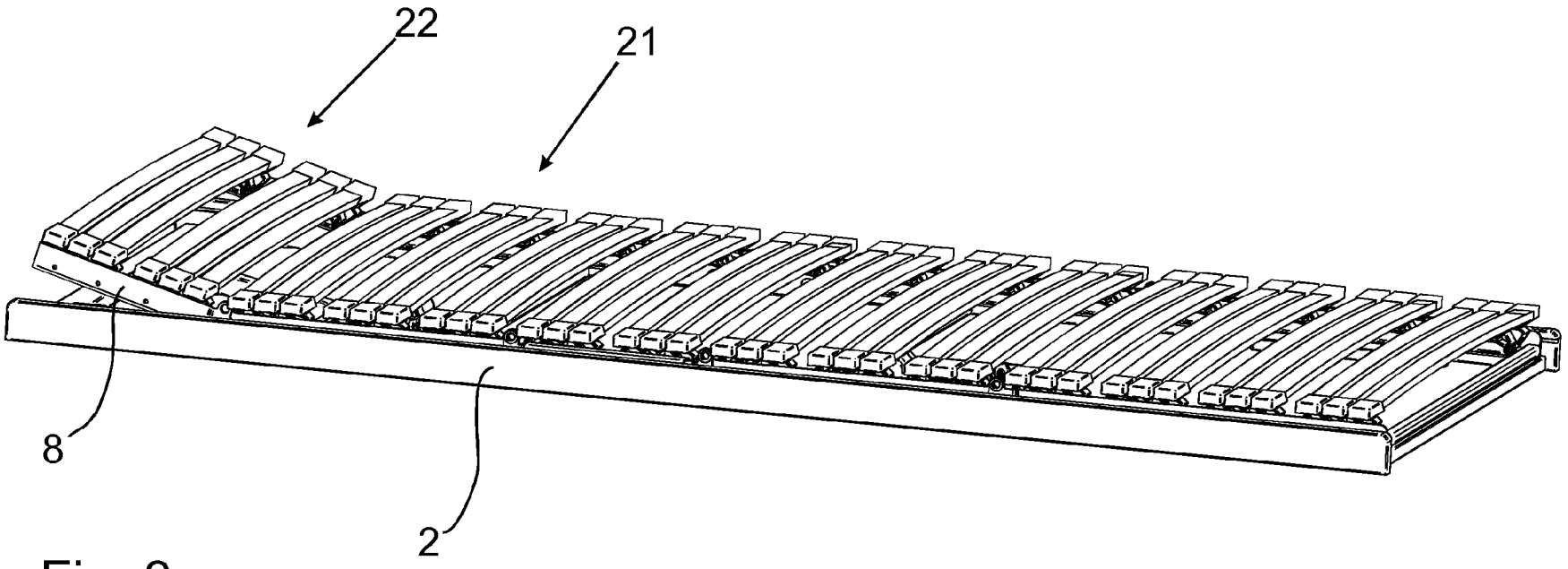
Figure 4:
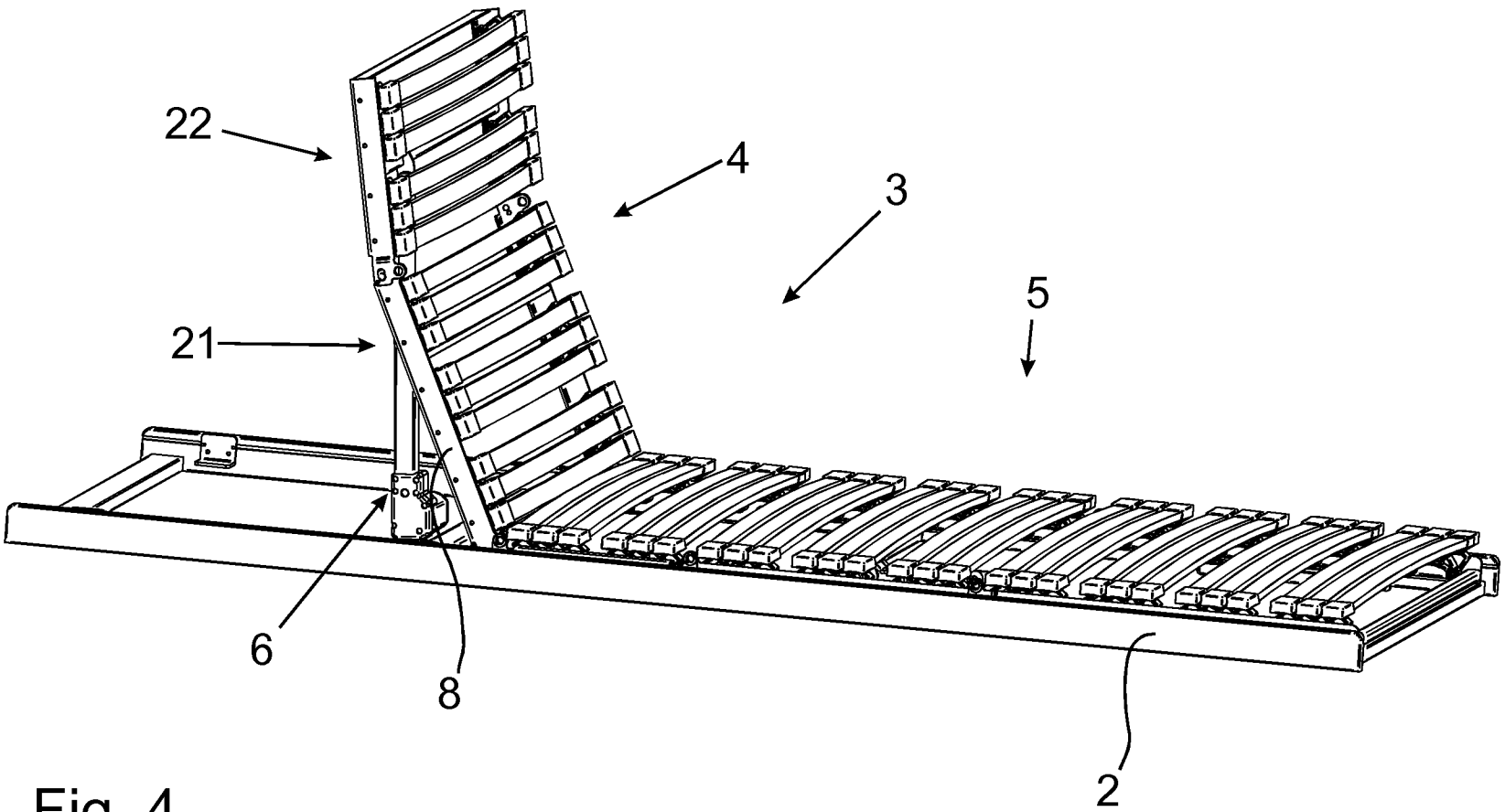
Figure 5:
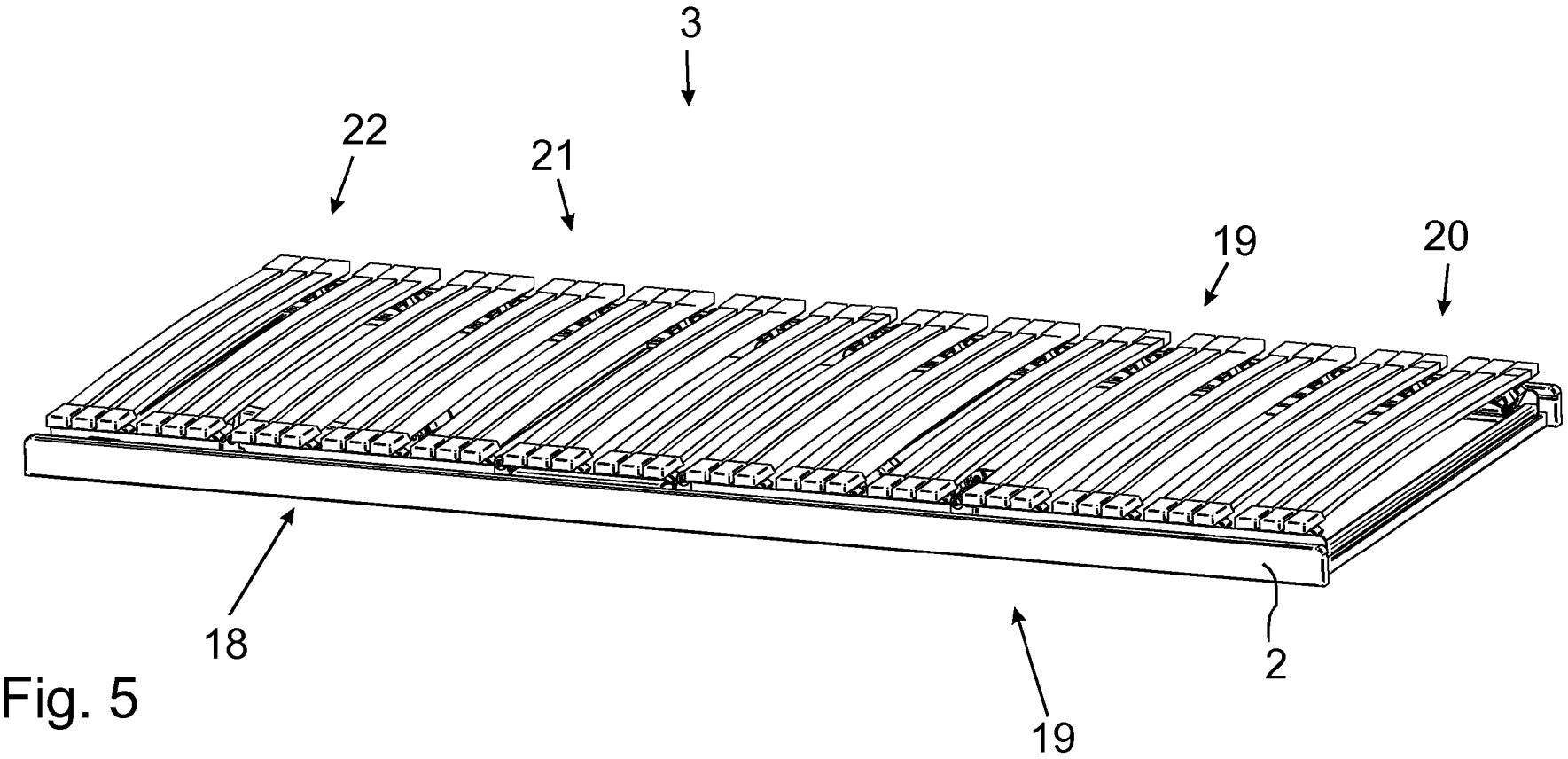

The adjustment unit 6 of the upper body section 18 formed by an electric drive 15 and a spindle drive 16 is arranged with its one end on the outer frame 2 and with its other end on the pivotable part 4 such that an actuation of the adjustment unit 6 starting from the flat position (see FIG. 5) first results in only the head section 22 being pivoted (see FIG. 3), and the back section 21 being pivoted as well (see FIG. 4) only upon a further actuation of the adjustment unit 6, wherein the angle of the head section 22 relative to the outer frame 2 is approximately 90° in the maximum adjusted position.

While the upper leg section 19 is continuously adjustable relative to the outer frame 2 by means of the adjustment unit 6, the lower leg section 20 further comprises on both sides a support device 7 for supporting against the outer frame 2.

In the flat position (see FIG. 5), all parts 4, 5 of the reclining surface 3, in particular the upper leg section 19 and the lower leg section 20 of the leg section 17, as well as the back section 21 and the head section 22 of the upper body section 18 are arranged in one plane.

The distance A between an inner side of the outer frame 2 facing the inner frame 8 and the inner frame 8 of all moveable parts 4, 5, 17-22 of the reclining surface 3 is at least 28 mm in order to prevent a user from getting trapped during operation of the adjustable slatted bed base 1.

The invention claimed is:

1. Slatted bed base having an outer frame (2) as well as a reclining surface (3) which comprises at least two parts (4, 5) and which is arranged at the outer frame (2), wherein at least one part is configured as a pivotable part (4), which can be pivoted around a pivot axis (S) relative to the outer frame (2) by means of an adjustment unit (6) from a flat position into at least one adjusted position, wherein the adjustment unit (6) is pivotable relative to the outer frame (2) about a first pivot point (D1) and relative to the pivotable part (4) about a second pivot point (D2), wherein the first pivot point (D1) for arranging the adjustment unit (6) relative to the outer frame (2) is arranged between the pivot axis (S) of the pivotable part (4) and the second pivot point (D2) of the adjustment unit (6), wherein relative to the reclining surface (3), the first pivot point (D1) is arranged below the pivot axis (S) and/or below the second pivot point (D2).

2. Slatted bed base according to claim 1, wherein the adjustment unit (6) comprises an electric drive (15), by means of which the pivotable part (4) of the reclining surface (3) is continuously pivotable from the flat position up to a maximum adjusted position.

3. Slatted bed base according to claim 1, wherein the pivot axis (S) and the second pivot point (D2) essentially have the same distance to the reclining surface (3).

4. Slatted bed base according to claim 1, wherein the pivot axis (S) and the two pivot points (D1, D2) are arranged such that they form a force triangle (K) in direction of the reclining surface (3).

5. Slatted bed base according claim 1, wherein the reclining surface (3) comprises an inner frame (8) arranged at the outer frame (2).

6. Slatted bed base according to claim 1, wherein the pivotable part (4) of the reclining surface (3) comprises an inner frame (8) arranged at the outer frame (2).

7. Slatted bed base according to claim 1, wherein the reclining surface (3) comprises multiple elastic support elements (10) arranged in parallel to one another.

8. Slatted bed base according to claim 1, wherein the pivotable port (4) of the reclining surface (3) comprises multiple elastic support elements (10) arranged in parallel to one another.

9. Slatted bed base according to claim 1, wherein the pivot axis (S) of the moveable part (4) is arranged in the area of the reclining surface (3), between the elastic support elements (10) and/or above the outer frame (2).

10. Slatted bed base according to claim 1, wherein the adjustment unit (6) is arranged inside the slatted bed base (1), arranged inside the outer frame (2), so that said unit does at least not protrude from the slatted bed base, respectively the outer frame (2), on the side opposite the reclining surface (3).

11. Slatted bed base according to claim 1, wherein the adjustment unit (6) comprises a linear adjuster, which comprises a spindle drive (16).

12. Slatted bed base according to claim 1, wherein the adjustment unit (6) is disposed in an easily replaceable manner.

13. Slatted bed base according to claim 12, wherein the adjustment unit (6) has an electric drive (15) which is arranged on a motor mount (14) fixed relative to the outer frame (2) and/or the pivotable part (4).

14. Slatted bed base according to claim 1, wherein the pivotable part (4) of the reclining surface (3) is a leg section (17) and/or an upper body section (18) pivotable relative to the outer frame (2).

15. Slatted bed base according to claim 14, wherein the pivotable leg section (17) is formed by an upper leg section (19) as well as by a lower leg section (20) which are fixed to one another in an articulate manner.

16. Slatted bed base according to claim 14, wherein the pivotable upper body section (18) is formed by a back section (21) as well as a head section (22) which are fixed to one another in an articulate manner.

17. Slatted bed base according to claim 16, wherein the adjustment unit (6) is arranged at the pivotable upper body section (18) such that when pivoting out of the flat position, first the head section (22) is pivoted and afterwards, upon further actuation of the adjustment unit (6), the back section (21) is pivoted as well.

18. Slatted bed base according to claim 1, wherein the distance (A) between the outer frame (2) and at least a part (4, 5) of the reclining surface (3) is at least 25 mm.

19. Slatted bed base according to claim 18, wherein the distance (A) is at least 28 mm.

20. Slatted bed base according to claim 18, wherein the distance (A) is between the outer frame (2) and at least a pivotable part (4) of the reclining surface (3).

21. Slatted bed base according to claim 18, wherein the distance (A) is between the outer frame (2) and all pivotable parts of the reclining surface (3).

* * * * *